US007641319B2

(12) United States Patent
Takizawa

(10) Patent No.: US 7,641,319 B2
(45) Date of Patent: Jan. 5, 2010

(54) DRIVING DEVICE AND DRIVING METHOD OF A LIQUID DROP EJECTING HEAD, AND LIQUID DROP EJECTING DEVICE

(75) Inventor: Fuminori Takizawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 508 days.

(21) Appl. No.: 11/503,696

(22) Filed: Aug. 14, 2006

(65) Prior Publication Data

US 2007/0229604 A1 Oct. 4, 2007

(30) Foreign Application Priority Data

Mar. 30, 2006 (JP) ..... 2006-094889

(51) Int. Cl.
*B41J 2/045* (2006.01)

(52) U.S. Cl. ..... 347/68

(58) Field of Classification Search ..... 347/68, 347/69–72, 5, 11; 400/124.16
See application file for complete search history.

(56) References Cited

U.S. PATENT DOCUMENTS

2006/0023010 A1 2/2006 Kobayashi et al.

FOREIGN PATENT DOCUMENTS

| | | |
|---|---|---|
| JP | 9-011457 | 1/1997 |
| JP | 9-039231 | 2/1997 |
| JP | 10-081012 | 3/1998 |
| JP | 2002-019106 | 1/2002 |

*Primary Examiner*—K. Feggins
(74) *Attorney, Agent, or Firm*—Fildes & Outland, P.C.

(57) ABSTRACT

There is provided a driving device of a liquid drop ejecting head, includes: a piezoelectric element for causing expulsion of liquid drops from an ejector which ejects liquid drops, a first electrode of the piezoelectric element being connected to a predetermined voltage; a switching section connected to a second electrode of the piezoelectric element, and able to switch among three states which are a charging state of the piezoelectric element, a discharging state of the piezoelectric element, and an open state; and a control section controlling switching of the switching section in a cycle which is shorter than a charging time or a discharging time of the piezoelectric element by the switching section.

12 Claims, 14 Drawing Sheets

DRIVING DEVICE AND DRIVING METHOD OF A LIQUID DROP EJECTING HEAD, AND LIQUID DROP EJECTING DEVICE

BACKGROUND

1. Technical Field

The present invention relates to a driving device and a driving method of a liquid drop ejecting head and to a liquid drop ejecting device, and in particular, relates to a driving device and a driving method of a liquid drop ejecting head which ejects a liquid drop due to vibration of a piezoelectric element such as a piezo element or the like, and to a liquid drop ejecting device.

2. Related Art

In a liquid drop ejecting device such as an inkjet printer or the like which ejects liquid drops by using a piezo element as an actuator, there are known, in generating pressure within a chamber in which liquid drops are filled, analog waveform driving which can generate an arbitrary pressure at an arbitrary time (e.g., the driving waveform shown in FIG. 12A), and rectangular wave driving which can control only the time and in which the pressure is constant (e.g., the driving waveform shown in FIG. 12B).

SUMMARY

According to a first aspect of the present invention, there is provided a driving device of a liquid drop ejecting head includes: a piezoelectric element for causing expulsion of liquid drops from an ejector which ejects liquid drops, one electrode of the piezoelectric element being connected to a predetermined voltage; a switching section connected to another electrode of the piezoelectric element, and able to switch among three states which are a charging state of the piezoelectric element, a discharging state of the piezoelectric element, and an open state; and a control section controlling switching of the switching section in a cycle which is shorter than a charging time or a discharging time of the piezoelectric element by the switching section.

BRIEF DESCRIPTION OF THE DRAWINGS

Exemplary embodiments of the present invention will be described in detail based on the following figures, wherein.

DETAILED DESCRIPTION

Examples of embodiments of the present invention will be described in detail hereinafter with reference to the drawings.

Figure 1:
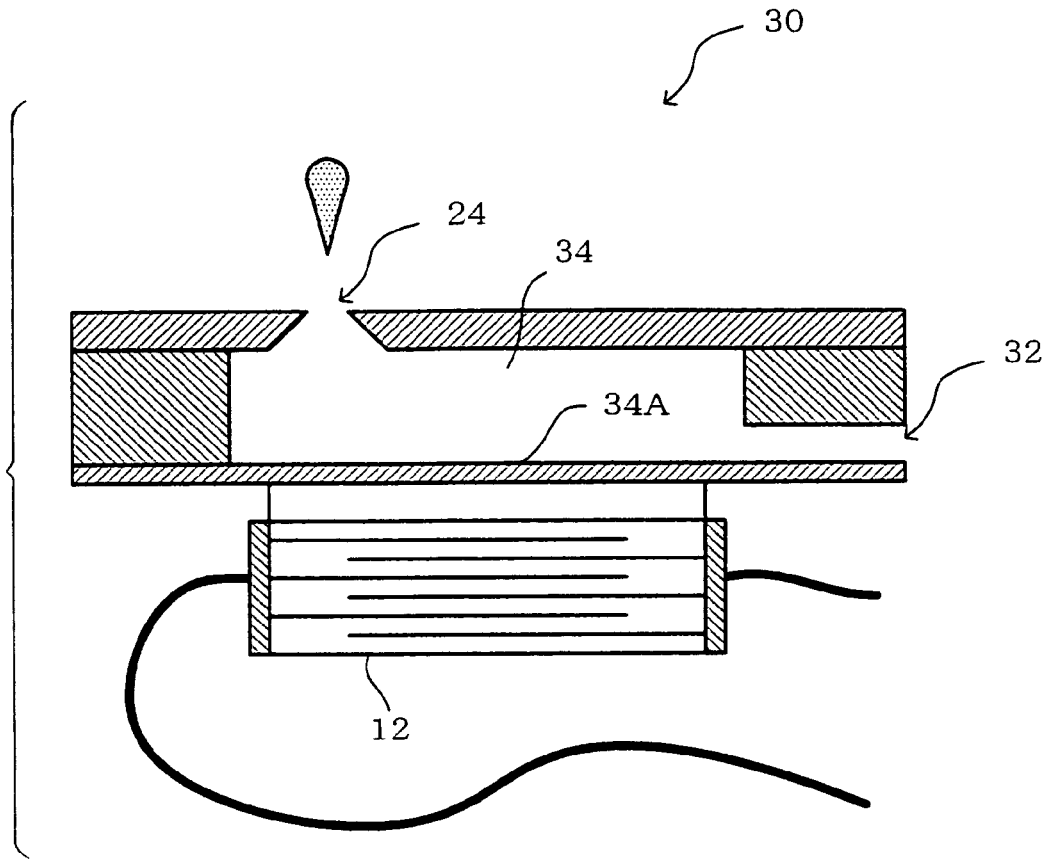
FIG. 1 is a drawing summarily showing an ejector structure which ejects a liquid drop per one nozzle of a liquid drop ejecting head relating to an exemplary embodiment of the present invention.

FIG. 1 is a drawing summarily showing an ejector structure which ejects a liquid drop per one nozzle of a liquid drop ejecting head relating to an exemplary embodiment of the present invention.

As shown in FIG. 1, at an ejector 30, a liquid (e.g., ink or the like) for ejecting liquid drops is filled into a pressure chamber 34 via a supply path 32 from a liquid drop tank (not shown) which stores the liquid. The liquid drops are ejected from a nozzle 24 which communicates with the pressure chamber 34.

A portion of the wall surface of the pressure chamber 34 is formed from a vibrating plate 34A. A piezoelectric element 12, such as a piezo element or the like, is provided at the vibrating plate 34A. By deforming and vibrating the vibrating plate 34A by the piezoelectric element 12, pressure waves are generated within the pressure chamber 34. Namely, due to the pressure waves which are generated by the vibration due to the piezoelectric element 12, the liquid stored within the pressure chamber 34 is ejected from the nozzle 24 as a liquid drop. The liquid is replenished to the pressure chamber 34 from the liquid drop tank (not shown) via the supply path 32.

By using a recording head in which plural nozzles 24 are lined-up along the transverse direction of a recording sheet for example, an image in the transverse direction of the recording sheet is recorded. By moving the recording sheet and the recording head relative to one another, an image can be recorded on the recording sheet.

Figure 2:
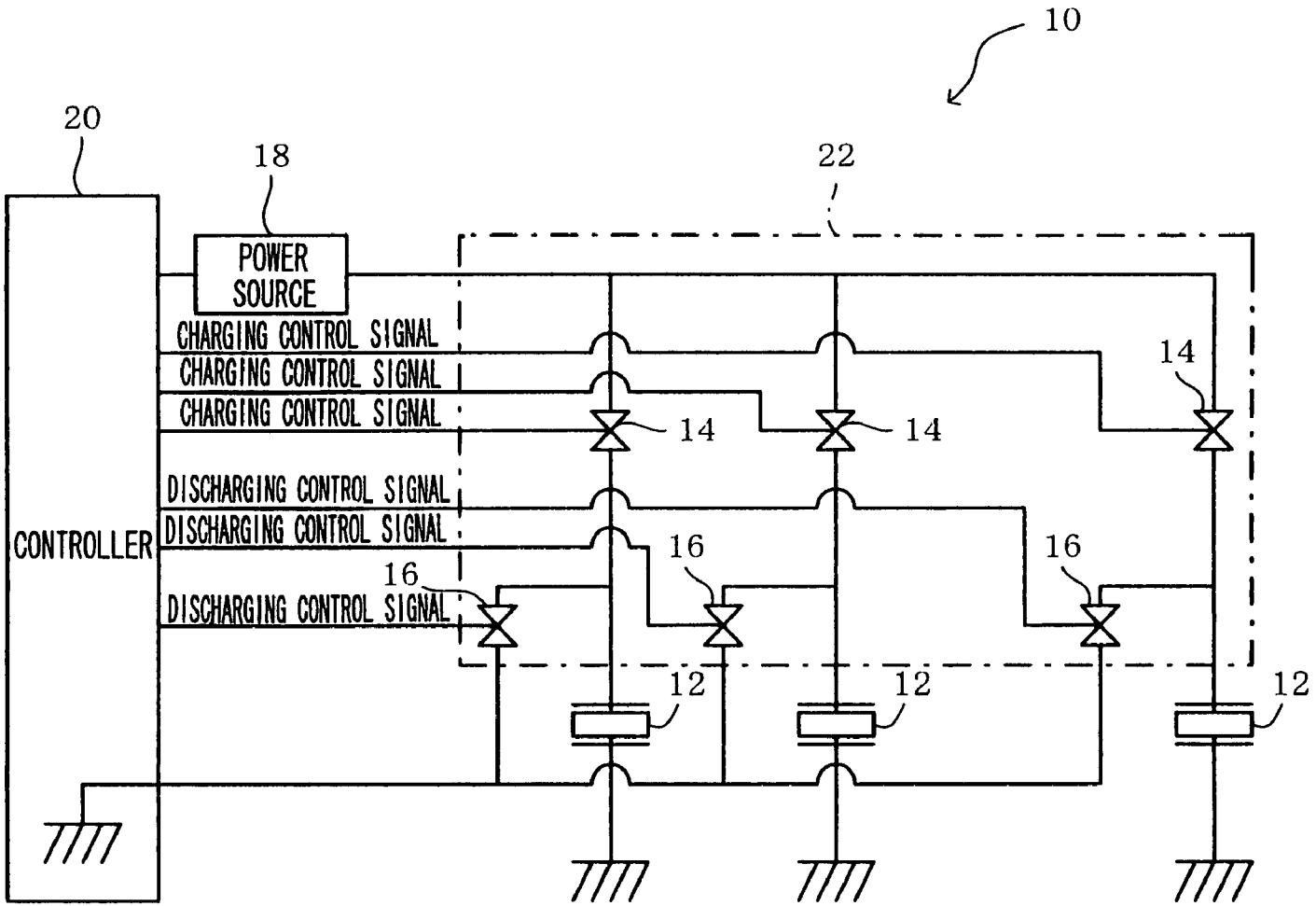
FIG. 2 is a drawing showing a driving device which drives the liquid drop ejecting head relating to the exemplary embodiment of the present invention.

FIG. 2 is a drawing showing a driving device which drives the liquid drop ejecting head relating to the exemplary embodiment of the present invention.

In the present exemplary embodiment, because the liquid drop ejecting head is structured by a plurality of the nozzles 24 being lined-up, a plurality of the piezoelectric elements 12 are provided in correspondence with the plural nozzles 24. The plural piezoelectric elements 12 are driven by a driving device 10.

One ends of the electrodes of the piezoelectric elements 12 which are provided in correspondence with the respective nozzles 24 have paths connected to a power source 18 via switches 14 for charging, and paths connected to the ground (GND) via switches 16 for discharging. The other ends of the electrodes of the piezoelectric elements 12 are connected to the ground which serves as a common electrode of all of the piezoelectric elements 12. Note that the respective switches 14 for charging and switches 16 for discharging are structured by a switch 1C 22 which is an aggregate of switches. Further, each of the switches 14 for charging and switches 16 for discharging may be structured by one simple transistor, or may be structured by a transmission gate at which current flows in both directions (a bi-directional gate).

The respective switches 14 for charging and switches 16 for discharging are connected to a higher-order controller 20, and the on/off operation is repeated during one ejecting cycle by the control of the controller 20. Namely, the controller 20 controls the on/off of the switch 14 for charging by a charging control signal, and controls the on/off of the switch 16 for discharging by a discharging control signal.

The rising characteristic when the switch 14 for charging is turned on, and the falling characteristic when the switch 16 for discharging, which holds the power source voltage as the initial state and which is connected to the GND, is turned on, are characteristics which substantially follow a time constant calculated from the on resistance of the transistor and the electrostatic capacity of the piezoelectric element 12. For example, the charging characteristic of 0 to 20 V in a case in which the on resistance of the transistor is 1 kΩ and the electrostatic capacity of the piezoelectric element 12 is 500 pF, is as shown in FIG. 3A, and the discharging characteristic is as shown in FIG. 3B.

The charging control signal and the discharging control signal outputted from the controller 20 are signals which on/off control in a cycle which is shorter than the charging time of the aforementioned charging characteristic and the discharging time of the discharging characteristic. In the present exemplary embodiment, each switch can be turned on/off per 10 MHz, i.e., per 0.1 [μsec]. Further, the power source voltage is 20 [V] at a time constant of 500 [pF]×1 [KΩ]=0.5 [μsec].

Figure 3A:
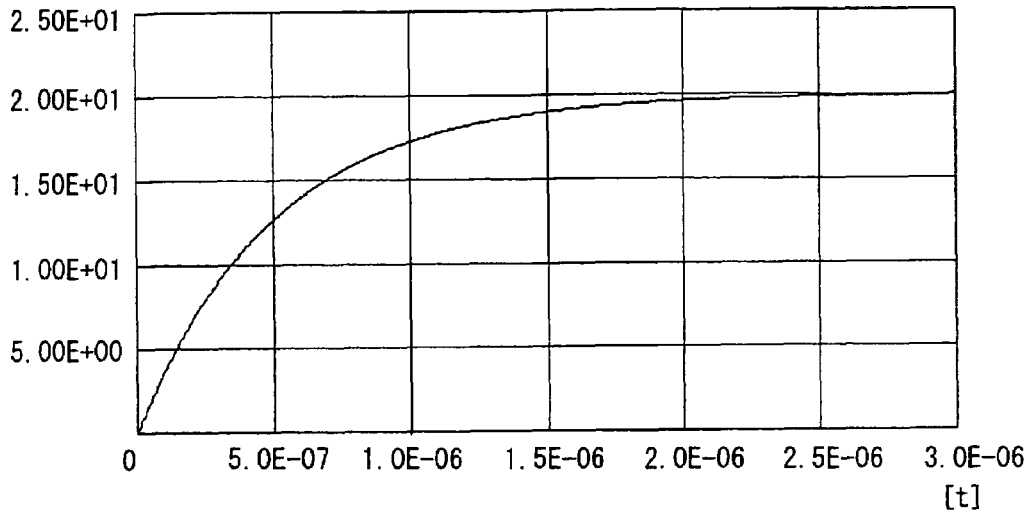
FIG. 3A is a graph showing a charging characteristic of a piezoelectric element.
Figure 3B:
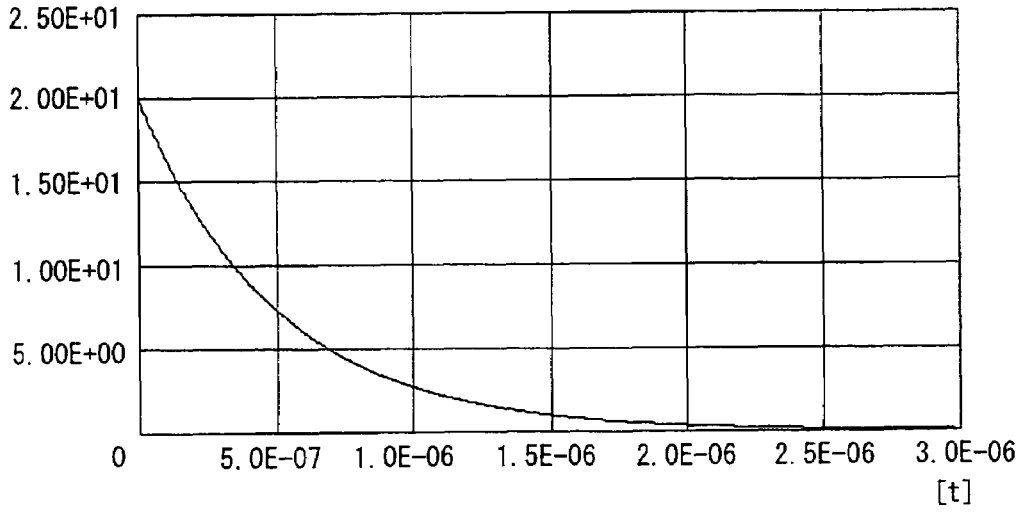
FIG. 3B is a graph showing a discharging characteristic of the piezoelectric element.

Here, a charging characteristic such as shown in FIG. 3A is obtained in a case in which the switch 14 for charging is turned on at a given instant and that state is maintained. Therefore, when the switch 14 for charging is on/off controlled each 0.1 [μsec], the voltage waveform shown in FIG. 4, which is just as if the charging characteristic of FIG. 3A were lengthened to twice as long in the direction of time, can be applied to the piezoelectric element 12. Further, by making the off section long with respect to the on section, a voltage waveform having an even more gradual slope can be generated. Conversely, in a case in which the switch 16 for discharging is turned on at a given instant and that state is maintained, the electrostatic capacity of the piezoelectric element 12 is discharged and the voltage drops. Therefore, by controlling the on/off of the switch 16 for discharging, a voltage waveform which is opposite that of the on/off of the switch 14 for charging can be generated. Note that a slight amount of shaking arises in the voltage waveform due to the on/off of each switch, but does not have a great affect on the piezoelectric element 12 and the responsiveness of the generation of pressure within the ejector 30.

Accordingly, by arbitrarily setting on/off patterns of the charging control signal and the discharging control signal outputted from the controller 20, a voltage waveform (waveform to be applied to the piezoelectric element 12), in which the slope and the voltage amplitude width are set freely, can be generated.

In the present exemplary embodiment, charging control signals and discharging control signals (which will simply be called "control signals" hereinafter when there is no particular need to distinguish therebetween) which are such that there are voltage waveforms which eject large drops, medium drops and small drops respectively, are stored in a memory included in the controller 20. The control signals are outputted in accordance with inputted data, such as image data expressing an image or the like, and any of a large, medium, or small liquid drop is ejected from each of the nozzles 24.

A concrete method of generating a waveform by the driving device 10 for a liquid drop ejecting head relating to the exemplary embodiment of the present invention will be explained next. Here, description will be given of only the generating of the voltage waveform to be applied to the piezoelectric element 12, and description of preparatory operations before liquid drop expulsion, as well as processing of the inputted data, processing after liquid drop expulsion, and the like will be omitted. Note that the voltage waveform which is generated is a waveform which provides a bias voltage of 15 [V] and which is amplified up and down therefrom.

Figure 5:
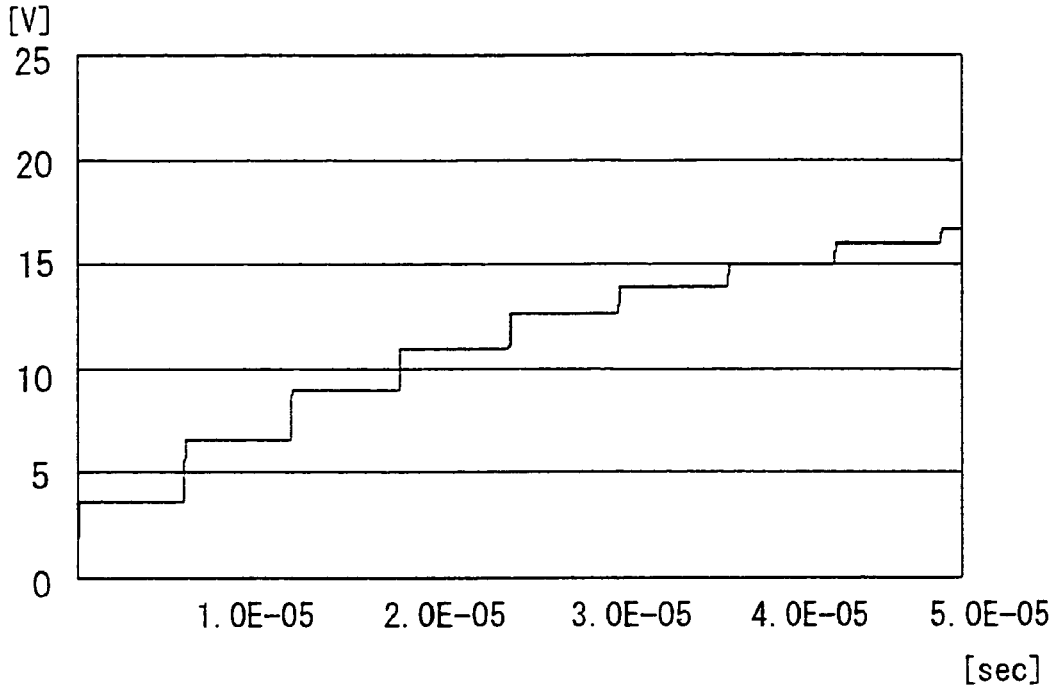
FIG. 5 is a drawing showing an example of a charging waveform up to a bias potential, and shows a case in which a charging control signal is on for 0.1 [μsec] among 6 [μsec]

First, before liquid drop expulsion, the switches 14 for charging of all of the nozzles 24 are controlled such that the piezoelectric elements 12 are charged to the bias potential. Note that the waveform, which is generated by on/off controlling the switch 14 for charging, may be a waveform having a slope of an extent that does not eject a liquid drop. Further, because it is unrelated to the ejecting cycle, an arbitrary time period can be used. Thus, in the present exemplary embodiment, as shown in FIG. 5, the controller 20 controls all of the switches (the switches 14 for charging and the switches 16 for discharging) such that data, which turns the charging control signal on only in the initial 0.1 [μsec] of the 6 [μsec], is repeated. By repeating this seven times, all of the piezoelectric elements 12 hold the bias potential of 15 [V] for about 40 [μsec].

Note that, also when the ejecting of the liquid drops ends, by controlling the discharging control signal similarly to the charging, the potential of the piezoelectric elements 12 can be made to be 0 [V] without ejecting liquid drops. Further, the piezoelectric elements 12 are equivalent to capacitors, and therefore, with the respective switches in off states, charges are held and the bias potential and the GND potential are held.

Figure 4:
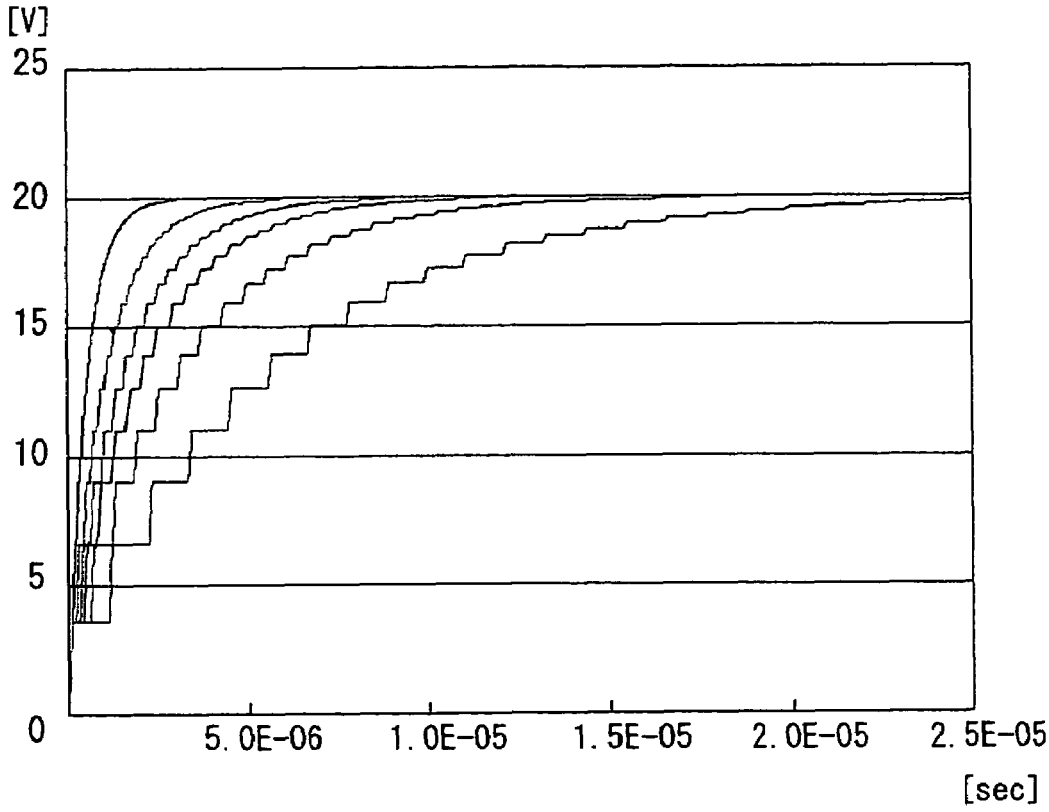
FIG. 4 is a drawing showing changes in a voltage waveform in accordance with switch control, and shows examples of changes in slope at times when an off to on time ratio is varied to 0, 1, 2, 3, 5, 10, and 20.

Then, by controlling the time that the charging control signal or the discharging control signal is on, a voltage change of an arbitrary slope such as shown in FIG. 4 can be made. Thus, a pseudo analog waveform is generated by the charging control signal and the discharging control signal.

Figure 6:
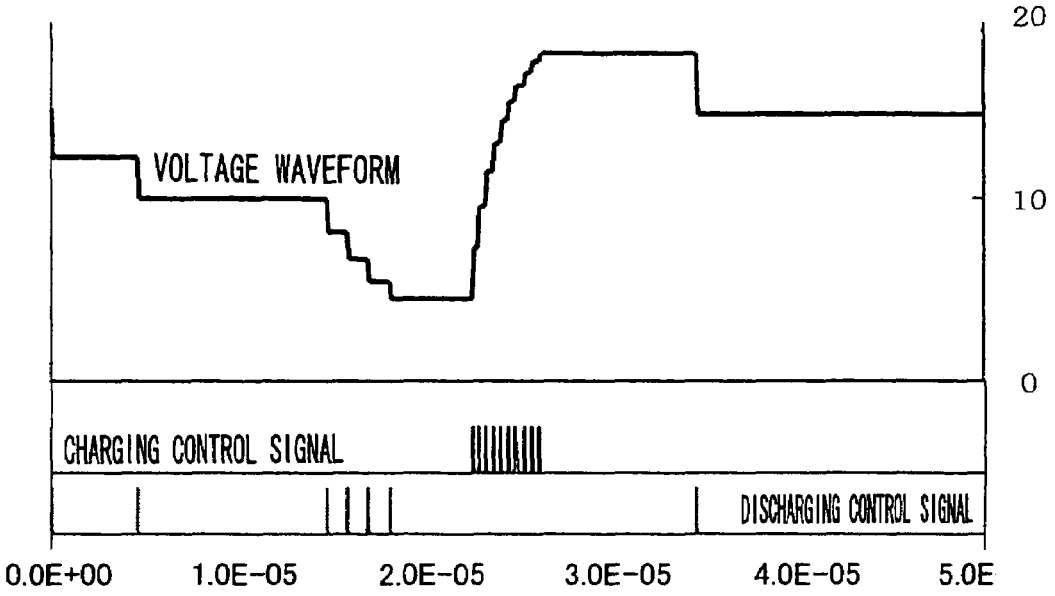
FIG. 6 is a drawing showing an example of a driving waveform which ejects a large drop.

For example, in the case of ejecting a large drop, by generating a charging control signal and a discharging control signal such as shown in FIG. 6 and on/off controlling the respective switches, a voltage waveform such as shown in FIG. 6 is generated and is applied to the piezoelectric elements 12. In this way, large (e.g., 10 pl) liquid drops can be ejected from the nozzles 24.

Figure 7:
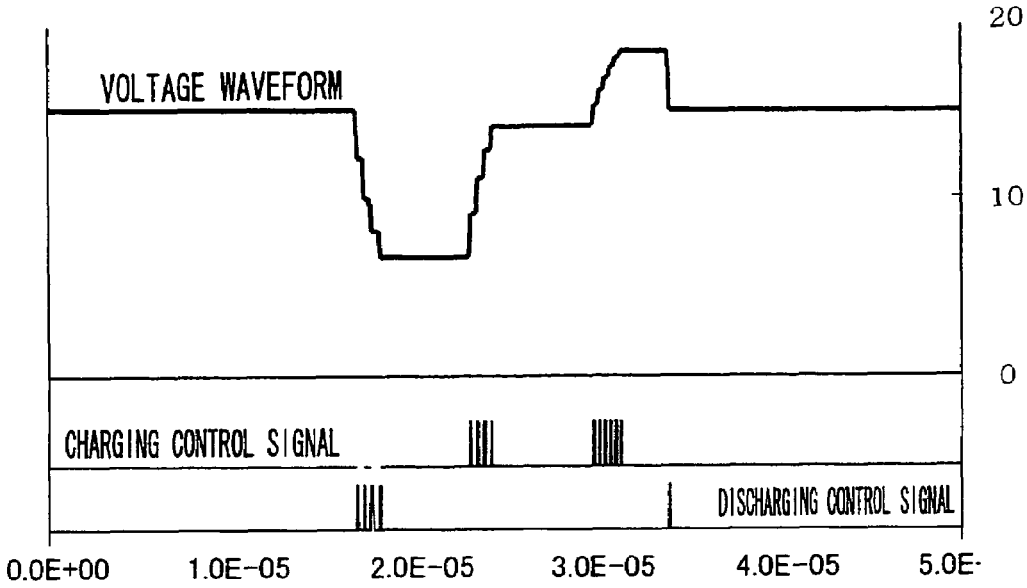
FIG. 7 is a drawing showing an example of a driving waveform which ejects a medium drop.

Further, in the case of ejecting a medium drop, by generating a charging control signal and a discharging control signal such as shown in FIG. 7 and controlling the on/off of the respective switches, a voltage waveform such as shown in FIG. 7 is generated and is applied to the piezoelectric elements 12. In this way, medium (e.g., 6 pl) liquid drops can be ejected from the nozzles 24.

Figure 8:
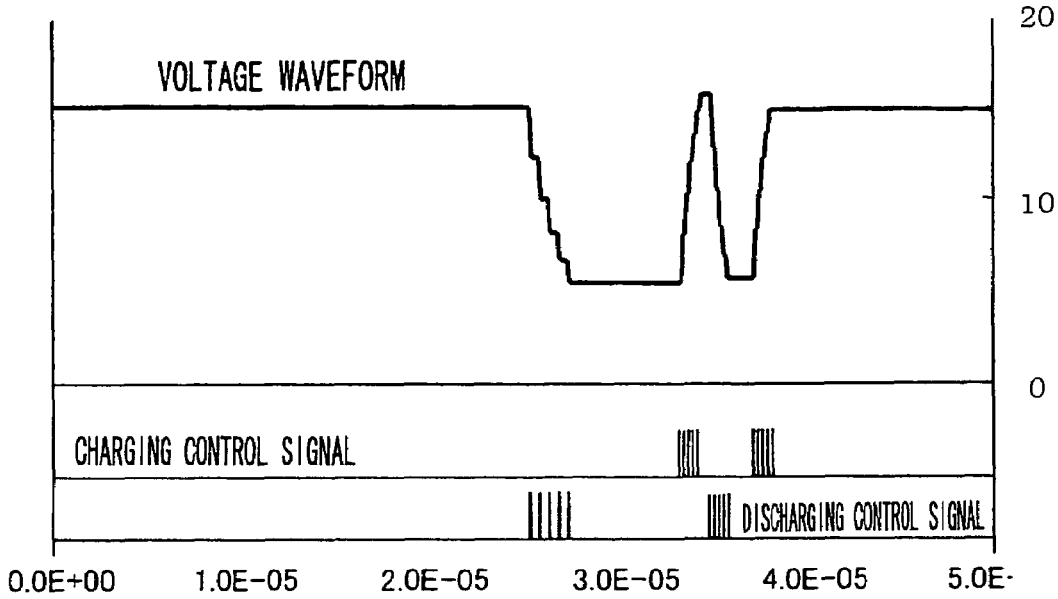
FIG. 8 is a drawing showing an example of a driving waveform which ejects a small drop.

Moreover, in the case of ejecting a small drop, by generating a charging control signal and a discharging control signal such as shown in FIG. 8 and controlling the on/off of the respective switches, a voltage waveform such as shown in FIG. 8 is generated and is applied to the piezoelectric elements 12. In this way, small (e.g., 2.5 pl) liquid drops can be ejected from the nozzles 24.

Namely, an arbitrary image can be recorded on a medium due to the controller 20 generating control signal data for each of the nozzles 24 and controlling the respective switches in accordance with liquid drop ejecting data (e.g., large drop, medium drop, small drop, no expulsion) for each of the individual nozzles 24 converted from the inputted data.

In this way, in the driving device 10 of a liquid drop ejecting head relating to the exemplary embodiment of the present invention, a pseudo analog waveform can be generated and the piezoelectric element 12 can be driven merely by the control of logic signals (the charging control signal and the discharging control signal), without the need for a waveform generating circuit and a waveform amplifying circuit which are usually needed. Therefore, a low-cost, small, and simple driving device can be provided. Moreover, because it is possible to apply plural driving waveforms to different piezoelectric elements 12 simultaneously, there is also no need for a switch IC which has a complex switch structure.

Further, in the driving device 10 of a liquid drop ejecting head relating to the present exemplary embodiment, in cases in which there are differences in characteristics per nozzle 24 due to dispersion in manufacturing, dispersion in parts (dispersion in the on resistances of the switches, dispersion in the electrostatic capacities of the piezoelectric elements 12, and the like), or the like, because the respective switches can be controlled per piezoelectric element 12 due to the switches being connected to the electrode side which is different than the common electrode, dispersion in ejecting can be corrected by using control signals which differ per nozzle 24, and highly-accurate ejecting is possible. Moreover, it can be thought that the characteristics of the liquid and the ejectors 30 will vary in accordance with environmental changes (temperature or humidity or the like). However, by providing a sensor or the like in accordance therewith and changing the control signals in accordance with the results of detection of the sensor, the stability of the image quality can be improved.

Figure 9:
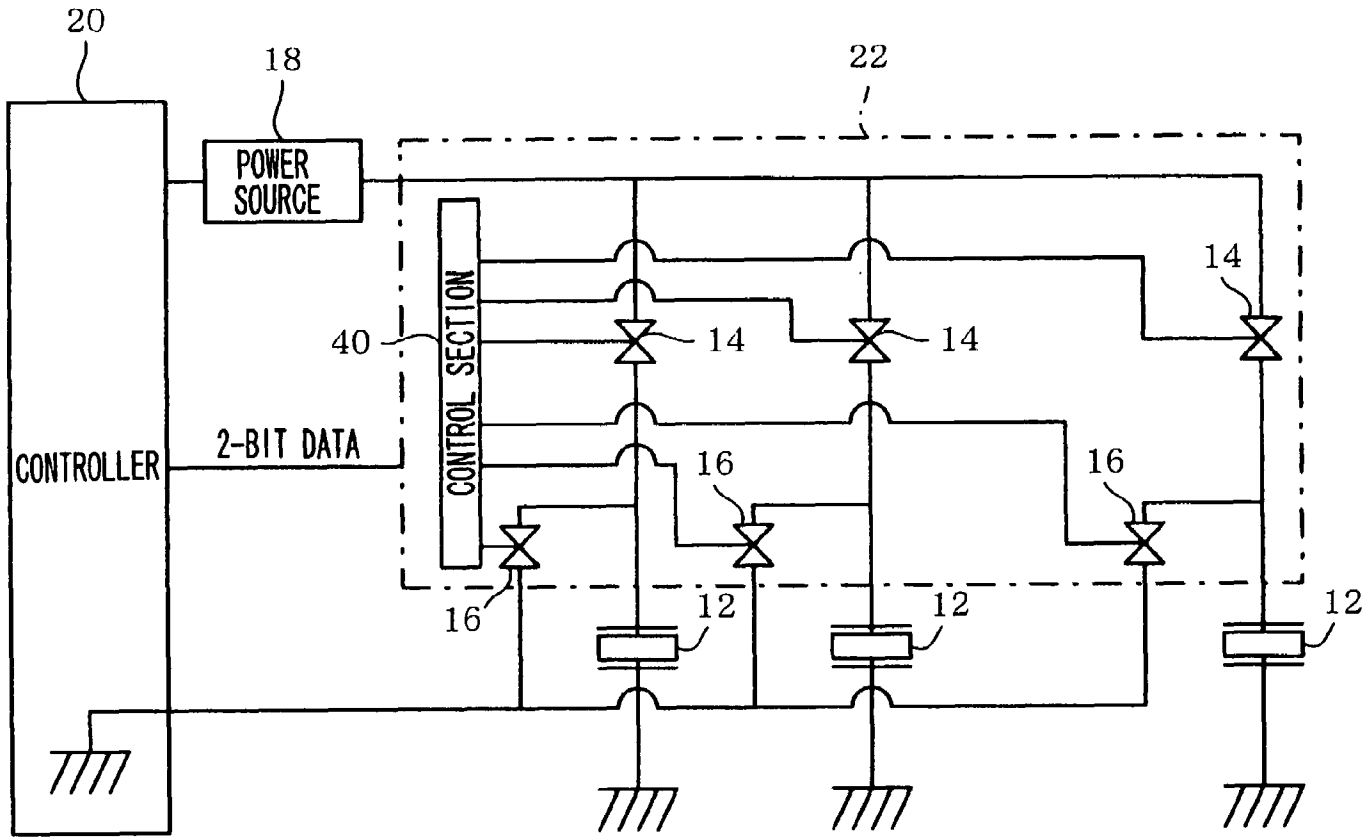
FIG. 9 is a drawing showing an example of providing a control section within a switch IC.

Note that, in the above-described exemplary embodiment, the control signals are sent from the controller 20 to the respective switches (the switches 14 for charging and the switches 16 for discharging). However, the present invention is not limited to the same. For example, as shown in FIG. 9, as a structure in which a control section 40 is provided at the switch IC 22, the control signals (charging control signals and discharging control signals) are transferred in advance to the switch IC 22, and merely by sending two-bit data, which expresses large, medium, small or no drop, from the controller 20 to the switch IC 22, the control section 40 of the switch IC 22 can control the respective switches.

Further, in the above-described exemplary embodiment, the control signals (charging control signals and discharging control signals) are stored in advance in a memory which is included in the controller 20, but the present invention is not limited to the same. Parameters such as times and voltages may be stored in the controller 20 as waveform data, and may be converted into control signals as needed.

Figure 10:
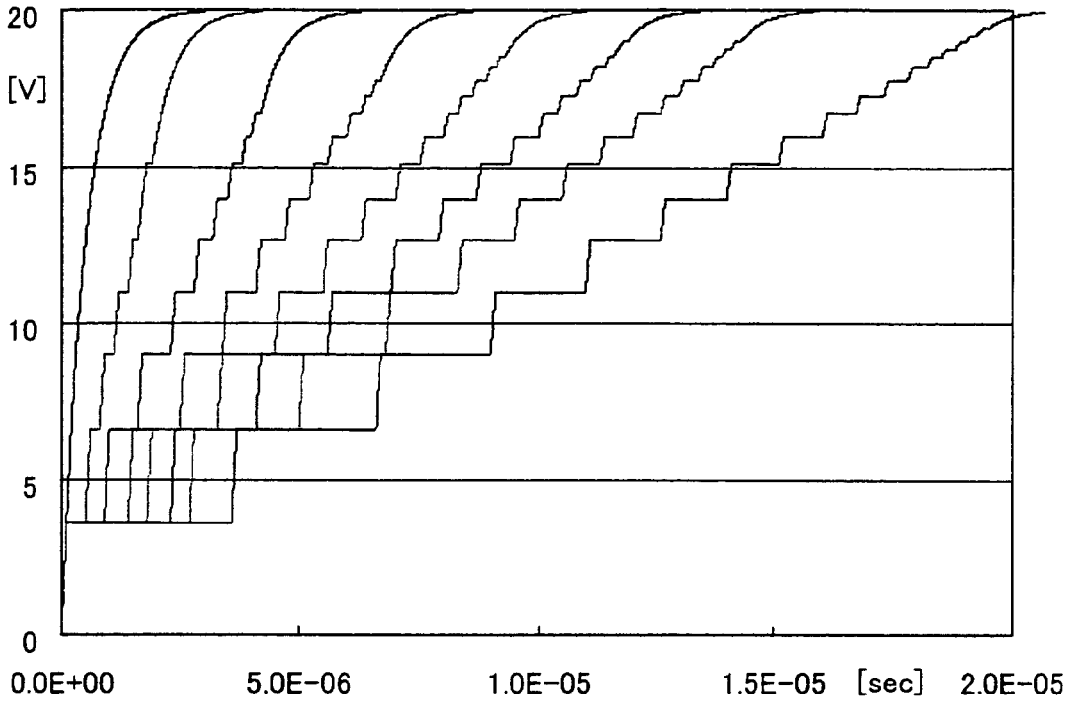
FIG. 10 is a drawing showing an example of changing an on/off ratio of a switch and generating a slope near to a straight line.

Moreover, although a driving waveform of an arbitrary slope is generated simply by changing the ratio of the on time in the above-described exemplary embodiment, the present invention is not limited to the same. For example, as shown in FIG. 10, control signals which vary the on/off ratio may be used in consideration of the charging characteristic and the discharging characteristic. By using control signals which vary the on/off ratio in this way, a driving waveform which is nearer to a trapezoidal wave than in the above-described exemplary embodiment can be generated.

The charging/discharging characteristics and the switching timing of the control signals (operation clock) in the above-described exemplary embodiment are described as examples, but are not limited to those described above. The time constant and the operation clock can be appropriately set in accordance with the actual system.

Further, in the above exemplary embodiment, the power source voltage is, as an example, 20 [V]. However, the present invention is not limited to the same, and the power source voltage may be made to be able to vary in accordance with the environment. The bias potential also is described above as 15 [V], but an arbitrary value can be used for the bias potential as well.

Moreover, in the present exemplary embodiment, it is thought that the start voltage and the end voltage differ per ejecting cycle due to the dispersion in the charging/discharging characteristics. However, a voltage change from a constant voltage can be realized by providing, at each piezoelectric element 12, a switch connected to a reference voltage, and turning the connected switch on such that the piezoelectric element 12 is initialized to the reference voltage at the end of or at the beginning of the expulsion cycle.

Figure 11:
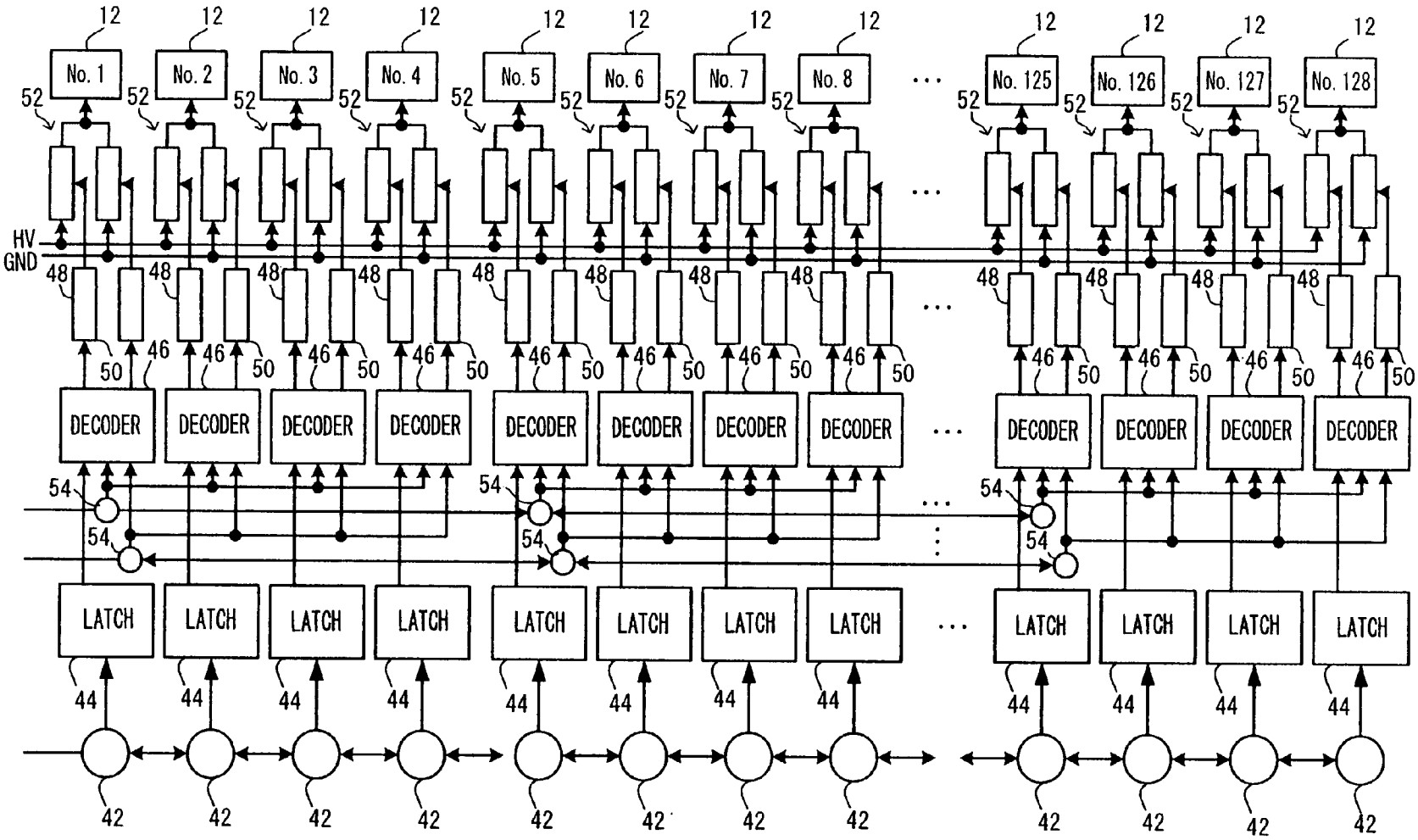
FIG. 11 is a drawing showing a structural example in a case in which a waveform is delayed by one clock each time for each block, where 4 nozzles structure one block, and the total 128 nozzles structure 32 blocks.
Figure 12A:
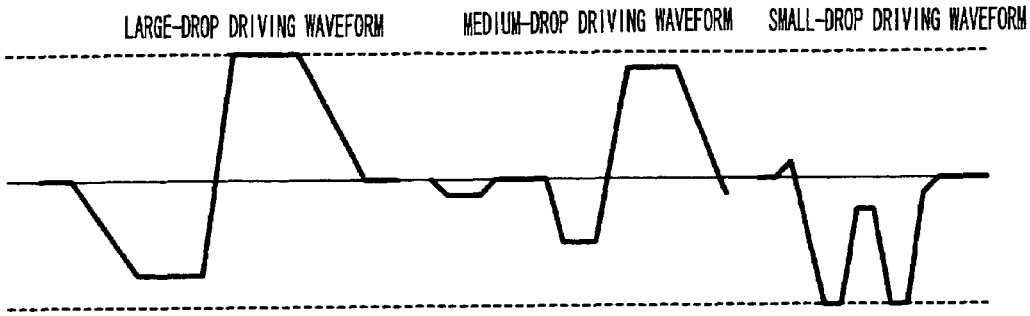
FIG. 12A is a drawing showing an example of an analog waveform of analog waveform driving.
Figure 12B:
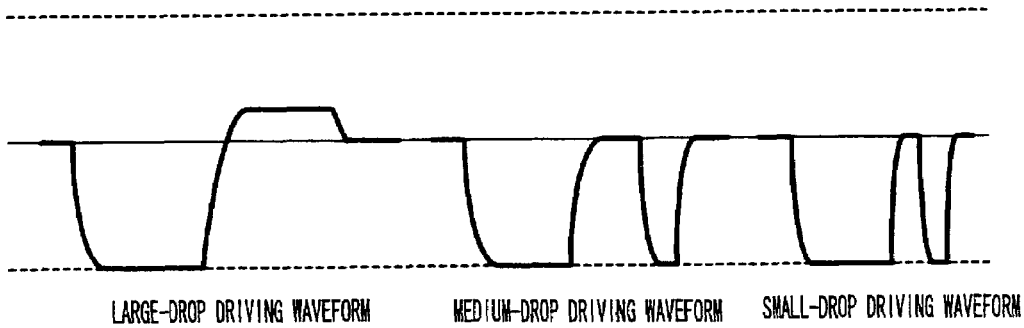
FIG. 12B is a drawing showing an example of a rectangular wave of rectangular wave driving.

The above-described exemplary embodiment may be structured such that the plural piezoelectric elements 12 are divided into plural groups, and are driven by on/off data being transmitted at timings which are offset one clock-by-one clock or more per group. Description is given hereinafter of a case in which the plural piezoelectric elements 12 are divided into plural groups, and are driven by the on/off data being transmitted clock-by-clock per group. For example, FIG. 11 illustrates an example of a case in which four of the nozzles 24 are made to be one block such that the total 128 nozzles are 32 blocks, and, at each block, the waveform is delayed clock-by-clock.

In this case, a shift register 42 for image data transfer, a latch circuit 44, a decoder 46, a level shifter 48 for charging, a level shifter 50 for discharging, and a driver 52 are provided in accordance with each piezoelectric element 12.

The shift register 42 for image data transfer shifts data to the adjacent register clock-by-clock. The image data are outputted from the respective shift registers 42 for image data transfer to the latch circuits 44, are latched at the latch circuits 44, and are outputted to the decoders 46. Note that explanation is given by using as an example a case in which 0 (no drop) and 1 (there is a drop) are used as the image data. However, as in the above-described exemplary embodiment, four values (large drop, medium drop, small drop, no drop) or the like can be used.

Shift registers 54 for waveform data transfer are connected to the decoders 46. A number of the shift registers 54 for waveform data transfer are provided in correspondence with each block. Further, for example, 16 rows of the shift registers 54 for waveform data transfer are provided and are set in advance such that each row transfers predetermined waveform data (a control signal) of a different type, and waveform data corresponding to the ejecting characteristic or the image data or the like of each piezoelectric element 12 is selected. Namely, the decoders 46 select waveforms corresponding to the image data from the shift registers 54 for waveform data transfer, and output the selected waveforms to the level shifters 48 for charging and the level shifters 50 for discharging. Note that the shift registers 54 for waveform data transfer transfer the waveform data to the adjacent register per clock. Namely, the waveform data is transferred to the level shifters 48 for charging and the level shifters 50 for discharging in block units.

The level shifters 48 for charging are provided in correspondence with the switches 14 for charging, and the level shifters 50 for discharging are provided in correspondence with the switches 16 for discharging. The control signals (the charging control signals and the discharging control signals) are outputted to the drivers 52 via the respective level shifters.

The drivers 52 control the on/off of the respective switches 14 for charging and switches 16 for discharging in accordance with the control signals outputted from the level shifters 48 for charging and the level shifters 50 for discharging.

Due to such a structure, the shift registers 54 for waveform data transfer transfer the waveform data to the adjacent register per one clock. Therefore, waveforms are selected and liquid drops are ejected per clock. The liquid drops can be ejected in block units, and it is not the case that the liquid drops are ejected from all of the nozzles 24 all at once. Therefore, the peak current at the time of liquid drop expulsion can be dispersed, and the design of the power source circuit is simple.

Figure 13A:
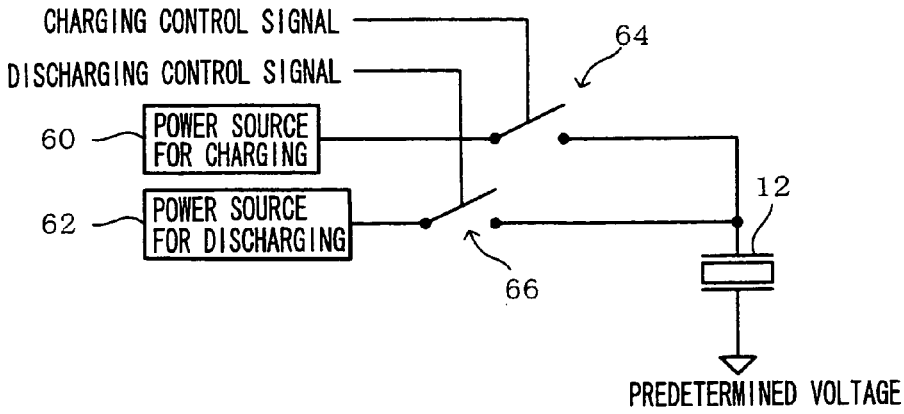
FIG. 13A is a drawing showing, in a simplified manner, a driving device which drives the liquid drop ejecting head relating to the exemplary embodiment of the present invention.

Note that, in the above-described exemplary embodiment, described simply, the state of application of voltage to the piezoelectric element 12 can be made to be any of three states (charging state, discharging state, open state) by using a first switch 64 for connecting a power source 60 for charging to the piezoelectric element 12 and a second switch 66 for connecting a power source 62 for discharging to the piezoelectric element 12 as shown in FIG. 13A, and the on/off of the first switch 64 is controlled in accordance with the charging control signal, and the on/off of the second switch 66 is controlled in accordance with the discharging control signal. However, the present invention is not limited to the same, and effects similar to those of the above-described exemplary embodiment can be achieved even with structures such as shown in FIGS. 13B and 13C for example.

Figure 13B:
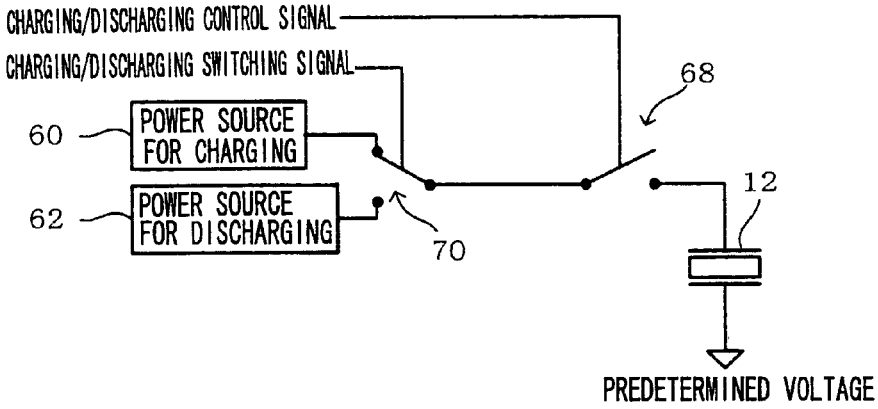
FIG. 13B is a drawing for explaining a modified example of the driving device which drives the liquid drop ejecting head relating to the exemplary embodiment of the present invention.
Figure 13C:
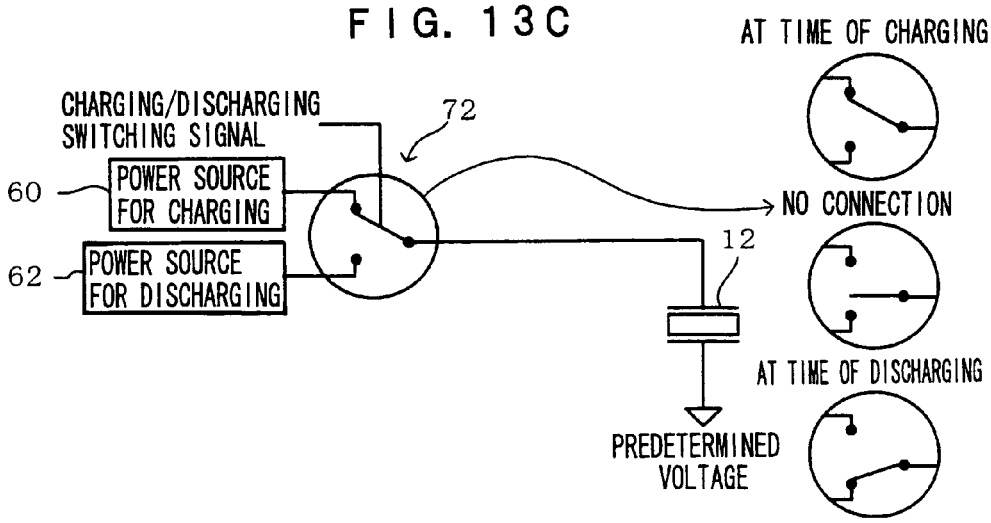
FIG. 13C is a drawing for explaining a modified example of the driving device which drives the liquid drop ejecting head relating to the exemplary embodiment of the present invention.

In the case of FIG. 13B, a first switch 68, which switches which of the power source 60 for charging and the power source 62 for discharging is connected to the piezoelectric element 12, and a second switch 70, which switches between connecting the first switch 68 and the power source 60 for charging or connecting the first switch 68 and the power source 62 for discharging, are used, such that the state of application of voltage to the piezoelectric element 12 can be made to be any of three states (charging state, discharging state, open state). The first switch 68 is controlled in accordance with a charging/discharging control signal, and the second switch 70 is controlled in accordance with a charging/discharging switching signal. In this way, operation which is similar to that of the above-described exemplary embodiment can be carried out. In the case of FIG. 13C, by using a single switch 72, the connection of the piezoelectric element 12 can be switched between the power source 60 for charging, no connection (open), and the power source 62 for discharging, and the connected state of the switch 72 is switched in accordance with the charging/discharging control signal. In this way, operation which is similar to that of the above-described exemplary embodiment can be carried out.

Figure 14:
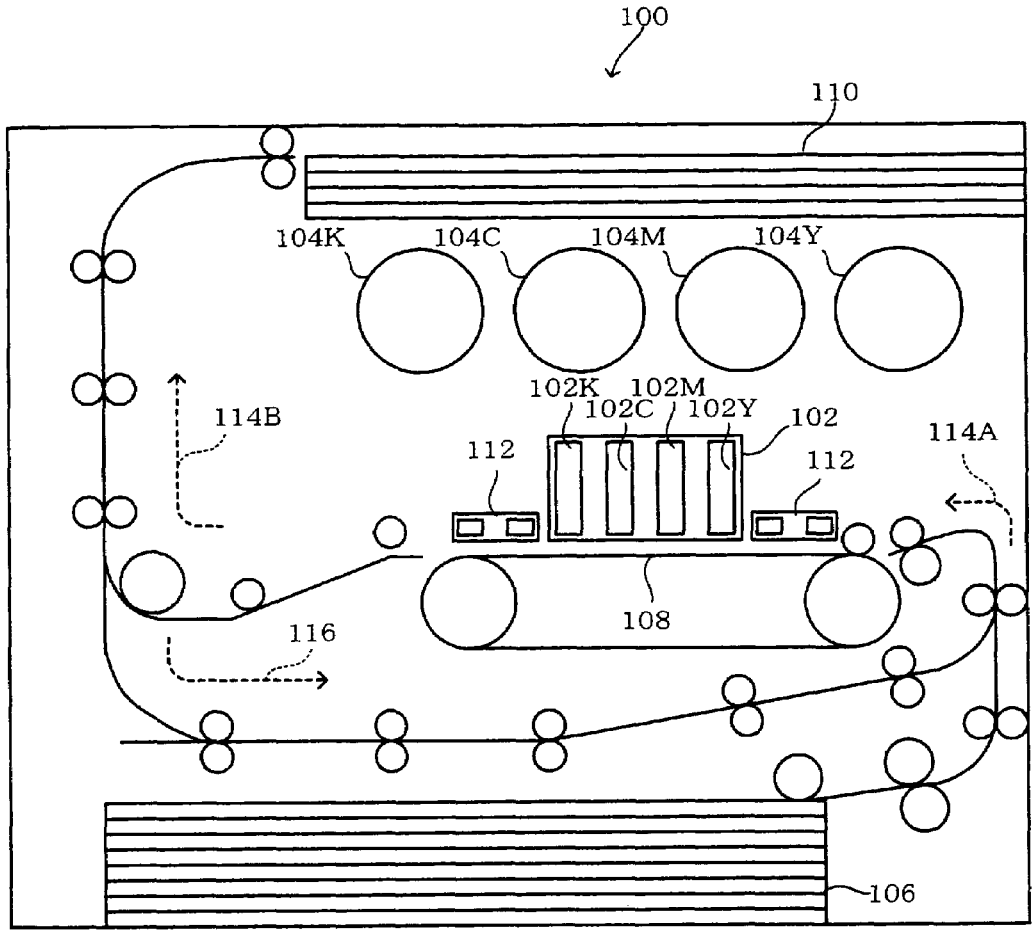
FIG. 14 is a drawing showing an example of a liquid drop ejecting device provided with the driving device which drives the liquid drop ejecting head relating to the exemplary embodiment of the present invention.

Next, an example of a liquid drop ejecting device, which is provided with the driving device which drives a liquid drop ejecting head relating to the exemplary embodiment of the present invention, will be described. FIG. 14 is a drawing showing an example of a liquid drop ejecting device 100 relating to an exemplary embodiment of the present invention.

As shown in FIG. 14, the liquid drop ejecting device 100 relating to the exemplary embodiment of the present invention has recording heads 102 (102Y through 102K) of the colors of Y (yellow), M (magenta), C (cyan), and K (black) which are lined-up from the upstream side in the conveying direction of a sheet P, and has ink tanks 104Y through 104K which store inks to be supplied to the recording heads 102 of the respective colors. When description is given hereinafter without particularly differentiating among the recording heads 102Y through 102K and the ink tanks 104Y through 104K of the respective colors, the final letter at the end of the reference numeral will be dropped, and they will be called the recording heads 102 and the ink tanks 104.

The liquid drop ejecting device 100 has a sheet feed tray 106 which accommodates the sheets P which serve as recording media, an endless-belt-shaped conveying body 108 which is disposed so as to oppose the recording heads 102 and which conveys the sheet P, a catch tray 110 onto which the sheet P after printing is discharged, and maintenance units 112 which clean the nozzles 24 of the recording heads 102.

A plurality of conveying rollers are provided at the liquid drop ejecting device 100 so as to form a first conveying path, which is formed from a path 114A from the sheet feed tray 106 to the conveying body 108 and a path 114B from the conveying body 108 to the catch tray 110, and a second conveying path 116, which is from the path 114B of the first conveying path to the conveying body 108 in the opposite direction.

At the path 114A of the first conveying path, the sheets P are conveyed one-by-one from the sheet feed tray 106 to the conveying body 108 by the plural conveying rollers. At the path 114B, the sheets P are conveyed by the plural conveying rollers to the catch tray 110. In the present exemplary embodiment, the second conveying path 116 is provided such that the sheets P can be inverted and doubled-sided printing is possible.

The conveying body 108 has the belt which is trained over two rollers. Attraction by charges can be used as the method for holding the sheet P by the conveying body 108. Namely, the sheet P is pushed against the belt by a charging roller, and charges are applied to the sheet P such that attractive force is generated.

The recording head 102 is structured such that a plurality of head units are connected together along the direction (called the main scanning direction) which is orthogonal to the sheet conveying direction, at a head bar (not shown) of a length which corresponds to the width of the sheet P. The recording head 102 has a printing region corresponding to the maximum width of the sheet P. At each head unit, a plurality of the ejectors 30 (nozzles 24) of the above-described exemplary embodiment which eject ink drops are lined-up in the same direction as the direction in which the head units are lined-up. The liquid drop ejecting device 100 can print the entire width of the sheet P by carrying out recording while conveying only the sheet P while keeping the recording heads 102 fixed and not main-scanning them. Note that any of various, known inks can be utilized as the inks which are used here. For example, inks such as water-based inks, oil-based inks, solvent inks, or the like can be used.

In accordance with the first aspect of the present invention, one electrode of the piezoelectric element is connected to a predetermined voltage (e.g., common ground or the like). By applying voltage to the piezoelectric element, a liquid drop is ejected from the ejector due to the vibration of the piezoelectric element.

Because the piezoelectric element is equivalent to a capacitive load, the charging/discharging of the piezoelectric element is carried out by switching the switching section, which is connected to the other electrode of the piezoelectric element, among three states which are a charging state, a discharging state, and an open state. Namely, the charging and discharging of the piezoelectric element are carried out by switching of the switching section, and the voltage applied to the piezoelectric element can be controlled.

At the control section, the switching of the switching section is controlled at a cycle which is shorter than the charging time or the discharging time of the piezoelectric element by the switching section. Namely, the switching of the switching section is controlled at a cycle which is shorter than the charging time or the discharging time which is determined mainly by the on resistance of the switching section and the electrostatic capacity of the piezoelectric element. In this way, the voltage waveform applied to the piezoelectric element is a voltage waveform corresponding to the switching of the switching section. Accordingly, by controlling the switching of the switching section such that there is a voltage waveform corresponding to the liquid drop to be ejected or the like, a pseudo analog waveform is generated and can be applied to the piezoelectric element.

Because the switching section is connected to the electrode of the piezoelectric element which is not the electrode to which the predetermined voltage is connected, the voltage waveform applied to each piezoelectric element can be changed. Therefore, dispersion in the ejecting of the ejectors can be absorbed.

Accordingly, a pseudo analog waveform which absorbs the ejecting dispersion of the ejectors can be generated.

For example, the switching section may be structured by a first switching section which is connected to an electrode of the piezoelectric element and is for carrying out charging of the piezoelectric element, and a second switching section which is connected to the other electrode of the piezoelectric element and is for carrying out discharging of the piezoelectric element (second aspect). Further, the switching section may be structured by a first switching section which is connected to the other electrode of the piezoelectric element, and a second switching section which is connected to the first switching section and which switches between charging and discharging of the piezoelectric element (third aspect). Or, the switching section may be structured by a single switch which can switch among the three states (fourth aspect).

Due to the control section generating a control signal for controlling the switching section and controlling the switching section in accordance with the control signal such that there is a voltage waveform corresponding to a liquid drop to be ejected, a voltage waveform which corresponds to the drop amount or the size of the liquid drop is applied to the piezoelectric element (fifth aspect). Therefore, a desired liquid drop can be ejected from an ejector. For example, due to the control section generating the control signal which corresponds to a liquid amount of the liquid drop to be ejected, a liquid drop speed of the liquid drop to be ejected, or slight vibration of an extent that does not eject a liquid drop, the liquid amount to be ejected from the ejector, the liquid drop speed, slight vibration to an extent that does not eject a liquid drop, and the like can be controlled (sixth aspect).

The control section may generate the control signal which corresponds to a difference in characteristics of the ejectors (seventh aspect). Or, the control section may generate the control signal which corresponds to a device environment of the liquid drop ejecting head (eighth aspect). In this way, dispersion in the ejecting of the liquid drops due to differences in the characteristics of the ejectors, or dispersion in the ejecting of the liquid drops due to changes in the device environment, can be controlled.

Note that, if the switching section is structured by a semiconductor integrated circuit, the control section may be provided within the semiconductor integrated circuit (ninth aspect). Signals controlling plural switching sections can be recorded in advance, or can be received from a high order and stored, and the control section can control the respective switching sections in accordance with the stored signals and image data from an external controller. In this way, it suffices to only transfer the image data from the external controller at each ejecting cycle, and the number of wires can be reduced and control can be facilitated.

The control section may divide a plurality of the piezoelectric elements into groups, and control the switching section by shifting between the groups by one or more clocks which carry out on/off of the switching section (tenth aspect). In this way, by dividing the plurality of piezoelectric elements into groups and controlling the switching section by providing an offset of one or more clocks between the groups, voltage is not applied to all of the piezoelectric elements. Therefore, the voltage which is applied to the piezoelectric elements can be dispersed.

A driving method of a liquid drop ejecting head of an eleventh aspect of the present invention is a driving method of a liquid drop ejecting head which has a piezoelectric element for causing expulsion of liquid drops from an ejector which ejects liquid drops, one electrode of the piezoelectric element being connected to a predetermined voltage, and a switching section connected to another electrode of the piezoelectric element, and able to switch among three states which are charging of the piezoelectric element, discharging of the piezoelectric element, and open, the method including: controlling on/off of the switching section in a cycle which is shorter than a charging time or a discharging time of the piezoelectric element by the switching section.

In accordance with the eleventh aspect of the present invention, one electrode of the piezoelectric element is connected to a predetermined voltage (e.g., common ground or the like). By applying voltage to the piezoelectric element, a liquid drop is ejected from the ejector due to the vibration of the piezoelectric element.

Because the piezoelectric element is equivalent to a capacitive load, the charging/discharging of the piezoelectric element is carried out by switching the switching section, which is connected to the other electrode of the piezoelectric element, among three states which are a charging state, a discharging state, and an open state. Namely, the charging and discharging of the piezoelectric element are carried out by switching of the switching section, and the voltage applied to the piezoelectric element can be controlled.

Thus, by controlling the switching of the switching section at a cycle which is shorter than the charging time or the discharging time of the piezoelectric element by the switching section, the voltage waveform applied to the piezoelectric element is a voltage waveform corresponding to the switching of the switching section. Accordingly, by controlling the switching of the switching section such that there is a voltage waveform corresponding to the liquid drop to be ejected or the like, a pseudo analog waveform is generated and can be applied to the piezoelectric element.

Because the switching section is connected to the electrode of the piezoelectric element which is not the electrode to which the predetermined voltage is connected, the voltage waveform applied to each piezoelectric element can be changed. Therefore, dispersion in the ejecting of the ejectors can be absorbed.

Accordingly, a pseudo analog waveform which absorbs the ejecting dispersion of the ejectors can be generated.

Note that the driving devices of a liquid drop ejecting head of the first through tenth aspects may be installed in a liquid drop ejecting device (twelfth aspect).

As described above, in accordance with the present invention, the switching section, which carries out at least one of charging and discharging of the piezoelectric element, is provided at the electrode side which is different than the common electrode side of the piezoelectric element. The on/off of the switching section is controlled at a cycle which is shorter than the charging/discharging time of the piezoelectric element. In this way, at the electrode side which is different than the common electrode side, the on/off of the switching section is controlled, and a pseudo analog waveform is generated. Therefore, the present invention has the effect that a pseudo analog waveform which absorbs dispersion in ejecting can be generated.

What is claimed is:

1. A driving device of a liquid drop ejecting head, the driving device comprising:

a piezoelectric element for causing expulsion of liquid drops from an ejector which ejects liquid drops, a first electrode of the piezoelectric element being connected to a predetermined voltage;

a switching section connected to a second electrode of the piezoelectric element, and able to switch among three states which are a charging state of the piezoelectric element, a discharging state of the piezoelectric element, and an open state; and a control section controlling switching of the switching section in a cycle which is shorter than a charging time or a discharging time of the piezoelectric element by the switching section.

2. The driving device of a liquid drop ejecting head of claim 1, wherein the switching section has a first switching section which is connected to the second electrode of the piezoelectric element and is for carrying out charging of the piezoelectric element, and a second switching section which is connected to the second electrode of the piezoelectric element and is for carrying out discharging of the piezoelectric element.

3. The driving device of a liquid drop ejecting head of claim 1, wherein the switching section has a first switching section which is connected to the second electrode of the piezoelectric element, and a second switching section which is connected to the first switching section and which switches between charging and discharging of the piezoelectric element.

4. The driving device of a liquid drop ejecting head of claim 1, wherein the switching section has a single switch which can switch among the three states.

5. The driving device of a liquid drop ejecting head of claim 1, wherein the control section generates a control signal for controlling the switching section and controls the switching section in accordance with the control signal, such that there is a voltage waveform corresponding to a liquid drop to be ejected.

6. The driving device of a liquid drop ejecting head of claim 5, wherein the control section generates the control signal which corresponds to a liquid amount of the liquid drop to be ejected, a liquid drop speed of the liquid drop to be ejected, or slight vibration of an extent that does not eject a liquid drop.

7. The driving device of a liquid drop ejecting head of claim 5, wherein the control section generates the control signal which corresponds to a difference in characteristics of the ejectors.

8. The driving device of a liquid drop ejecting head of claim 5, wherein the control section generates the control signal which corresponds to a device environment of the liquid drop ejecting head.

9. The driving device of a liquid drop ejecting head of claim 1, wherein the switching section is formed by a semiconductor integrated circuit, and the control section is provided within the semiconductor integrated circuit.

10. The driving device of a liquid drop ejecting head of claim 1, wherein the control section divides a plurality of the piezoelectric elements into groups, and controls the switching section by shifting between the groups by one or more clocks which carry out on/off of the switching section.

11. A driving method of a liquid drop ejecting head which has a piezoelectric element for causing expulsion of liquid drops from an ejector which ejects liquid drops, a first electrode of the piezoelectric element being connected to a predetermined voltage, and a switching section connected to a second electrode of the piezoelectric element, and able to switch among three states which are charging of the piezoelectric element, discharging of the piezoelectric element, and open, the method comprising:

controlling on/off of the switching section in a cycle which is shorter than a charging time or a discharging time of the piezoelectric element by the switching section.

12. A liquid drop ejecting device comprising:

a driving device of a liquid drop ejecting head, the driving device including:

a piezoelectric element for causing expulsion of liquid drops from an ejector which ejects liquid drops, a first electrode of the piezoelectric element being connected to a predetermined voltage;

a switching section connected to a second electrode of the piezoelectric element, and able to switch among three states which are a charging state of the piezoelectric element, a discharging state of the piezoelectric element, and an open state; and a control section controlling switching of the switching section in a cycle which is shorter than a charging time or a discharging time of the piezoelectric element by the switching section.

* * * * *